United States Patent [19]

Wilson

[11] Patent Number: 4,683,902

[45] Date of Patent: Aug. 4, 1987

[54] POWERED MOVABLE STORAGE ENCLOSURE

[76] Inventor: Ralph A. Wilson, 29500-4 Heathercliff Rd., Malibu, Calif. 90265

[21] Appl. No.: 837,732

[22] Filed: Mar. 10, 1986

[51] Int. Cl.[4] ..... E04H 15/42; E04B 1/12; B65D 85/68

[52] U.S. Cl. ..... 135/105; 135/88; 52/63; 206/335

[58] Field of Search ..... 206/335; 160/DIG. 2; 135/105, 88, 903, 87, 90, 96, 101, DIG. 9; 52/63

[56] References Cited

U.S. PATENT DOCUMENTS

| | | | |
|---|---|---|---|
| 297,780 | 4/1984 | Frick | 135/90 |
| 844,220 | 2/1907 | Westbrooke | 135/87 X |
| 1,849,738 | 3/1932 | Amico | 135/90 |
| 2,508,679 | 5/1950 | McClellan et al. | 135/88 |
| 2,798,501 | 7/1957 | Oliver | 135/88 X |
| 3,178,216 | 5/1961 | Huber | 206/335 X |
| 3,254,657 | 6/1966 | Reger | 135/88 X |
| 3,463,174 | 8/1969 | Heller | 135/88 X |
| 3,964,781 | 6/1976 | Fenton | 52/63 X |
| 4,333,679 | 6/1982 | Hardy et al. | 135/96 X |
| 4,487,212 | 12/1984 | Moore | 135/88 X |

*Primary Examiner*—Robert A. Hafer
*Assistant Examiner*—D. Neal Muir
*Attorney, Agent, or Firm*—Jack C. Munro

[57] ABSTRACT

A tubular frame structure for enclosing a storage area having a pair of tubular frame sections located in juxtaposition to each other with the storage area located therebetween. Extending across the storage area and connecting the frame sections is an enclosed housing. A flexible sheet material cover is located within the storage area. This cover has an open bottom which is to be movable between a lower (covering) position to an upper (uncovering) position. The movement of the cover is accomplished by means of a pair of cables which are conducted through the tubular frame sections. These cables are in turn connected to an electrically operated motor device mounted within the housing.

6 Claims, 4 Drawing Figures

POWERED MOVABLE STORAGE ENCLOSURE

BACKGROUND OF THE INVENTION

The field of this invention relates to movable storage enclosures and more particularly to a cover that can be utilized to cover a substantially large object such as an automobile.

In today's society, vehicles have become a strong part of the American way of life. Several hundred million dollars plus is wrapped up in vehicles of all types. Since there is a substantial investment by most households in vehicles (1980 Census says 2.3 vehicles per household in the U.S.A.), and since Americans are obsessed with the care and maintenance of their vehicles, owners spend many millions more in care and upkeep of these vehicles.

Many individuals are fortunate to be able to house their vehicles in enclosed garage facilities. However, many others have to be content with open carports, open shelters, soft car covers, or nothing at all. Carports and shelters have open sides and offer little protection from weather. Soft covers set up undesirable conditions such as sweating and contamination. Further, putting on and removing car covers is a difficult task at best, and if it is a rainy/windy day, ever more difficult. Of course, vehicles in the open air have absolutely no protection at all. It is an accepted fact that adverse weather conditions are the biggest problem with respect to maintenance of vehicles both mechanically and cosmetically.

There is a need for a suitable storage enclosure which provides the advantage of a garage where none now exists. Such enclosure will provide weather protection for vehicles with the cover never coming directly in contact with the stored vehicle thereby removing any chance of sweating or contamination while providing a level of security to any that may already exist (burglar alarm).

SUMMARY OF THE INVENTION

The structure of the present invention relates to an open tubular frame type of unit which has an open front wall and an open back wall. An automobile can be driven within the storage compartment of the enclosure through either the front wall or the back wall. Supported by the frame of the enclosure within the storage compartment is a flexible sheet material cover which has a closed top which is fixedly secured to the frame. Extending from the top are depending side walls of the cover. The side walls are to be movable alongside the frame from an upper position located directly adjacent the top to a lower position located substantially directly adjacent the ground upon which the enclosure is located. The open peripheral edge of the cover includes a rigid member, such as a rod. At two corners this rod is fixedly secured to a cable, with the other two corners of the rod being fixedly secured to another cable. These cables are mounted through the tubular frame sections of the enclosure. These cables are to be movable simultaneously in opposite directions which will result depending side walls of the cover to be moved either to the upper position or to the lower position depending upon the direction of movement of the cables. These two cables are attached to an operating cable of a motor which is mounted within a housing. This housing is mounted on the frame of the enclosure. Activation of the motor can either be by a direct manual pressing of a switch or by use of an actuator assembly spaced from the motor such as a sound wave transmitting device.

Individuals owning enclosed garage facilities have been blessed with good protection and now have the added advantage of not having to deal with manually operating the heavy garage door due to the introduction of the automatic garage door opener. This invention purports to extend to those without enclosed garage facilities the opportunity of acquiring a relatively low cost motorized cover that will do for the user what the garage door opener does for those with garages. Morever, while many have the advantage of enclosed garage facilities at home, such is not the case where the person works, plays, or visits. Therefore, the structure of this invention will also offer an extension of protection to individuals with garages at locals outside of the home.

The primary objective of the present invention is to provide for an enclosure which can be quickly and easily installed at a desired location to obtain complete enclosing of an enlarged object such as an automobile.

Another objective of the present invention is to enclose the automobile or other similar type of object without the enclosure actually touching the object itself.

Another objective of the present invention is to provide for an enclosure which is capable of being removed and relocated with a minimum amount of difficulty.

Another objective of the present invention is to construct an enclosure which can be manufactured inexpensively and, therefore, sold to the ultimate consumer at a relatively inexpensive price.

Another objective of the present invention is to utilize a conventionally available motor operated assembly to achieve the opening and closing motion of the cover included within the enclosure of the present invention.

DETAILED DESCRIPTION OF THE SHOWN EMBODIMENT

Figure 2:
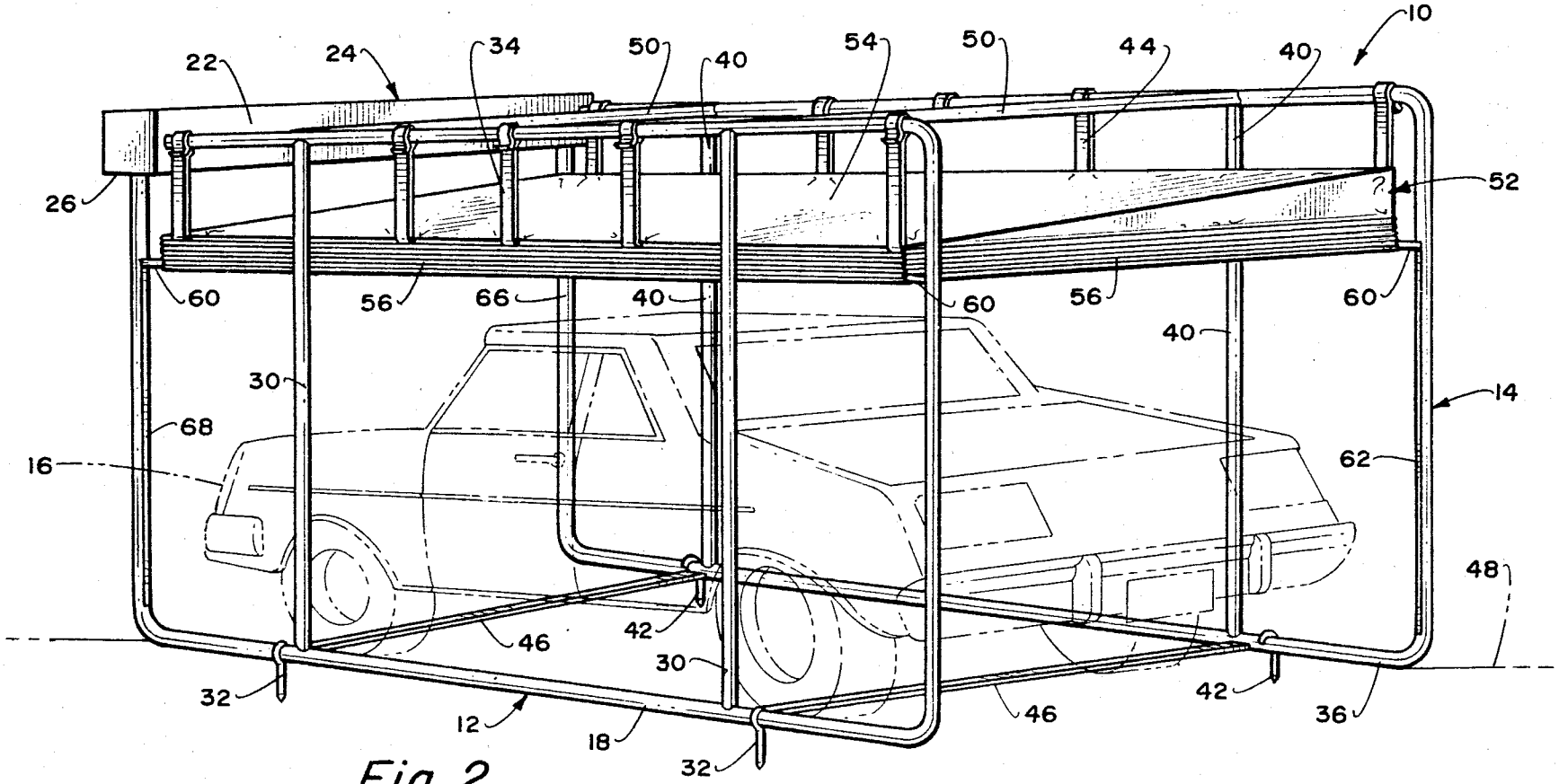
FIG. 2 is a view similar to FIG. 1, but showing the enclosure in an open position.

Referring particularly to the drawings, there is shown the movable storage enclosure 10 of this invention composed primarily of a pair of spaced-apart parallel side sections 12 and 14. Each of the side sections 12 and 14 are basically identical in configuration. Located between the side sections 12 and 14 is a storage compartment. In FIG. 2 of the drawings there is shown in phantom lines a representation of an automobile 16 located within the storage compartment.

The side section 12 includes a continuous tubular member 18 which forms the basic rectangular configuration of the side section 12. The tubular member 18 has a continuous internal chamber 20. One end of the tubular member 18 connects with the front surface 22 of a box-like housing 24. The remaining end of the tube 18 connects into the bottom surface 26 of the housing 24. The continuous internal chamber 20 connects with the interior cavity 28 of the housing 24. It is to be understood that normal materials of construction for the tubular member 18 will be plastic or aluminum.

The side section 12 includes a pair of vertically disposed braces 30. Connecting with the tube 18 is located against the ground 48 are a pair of stakes 32. The stakes 32 are to be physically driven into the ground 48 at a desired distance with the upper end of the stakes 32 connecting with the tube 18 to thereby secure the position of the side section 12 onto the ground. Attached to the portion of the tube 18 that is located the furthest from the ground 48 are a series of straps 34. The function of these straps 34 will be explained further on in this specification.

The side section 14 includes a peripheral tube 36 which has a continuous internal chamber 38. One end of the tube 36 connects to the front surface 22 with the other end of the tube 36 connecting with the bottom surface 26 of the housing 24. Connecting the upper portion of the tube 36 to the bottom portion of the tube 36 are a pair of vertical, spaced-apart, braces 40. The lowermost portion of the tube 36 is held into position onto the ground 48 by the pair of spaced-apart stakes 42. Also mounted on the uppermost section of the tube 36 are a plurality of straps 44 whose function will also be explained further on in this specification.

Connected between the lowermost sections of the tubes 18 and 36 are a pair of horizontal lower brace members 46. These brace members 46 will be located directly against the ground 48. Connected between the upper sections of the tubes 18 and 36 are a pair of horizontal braces 50.

It is to be noted that the housing 24 extends across the storage compartment. Also located within the storage compartment is a cover 52. The cover 52 is to be formed of a thin sheet flexible material such as canvas, plastic or the like. The cover 52 has a top section 54 the edges of which are connected to the straps 34 and 44. It is to be noted that straps 44 are shorter in length than straps 34. This is so the normal position of the top section 54 will be at an incline to permit snow and rain to run-off the top section 54 and not collect thereon. This top section 54 remains stationary at all times.

Figure 1:
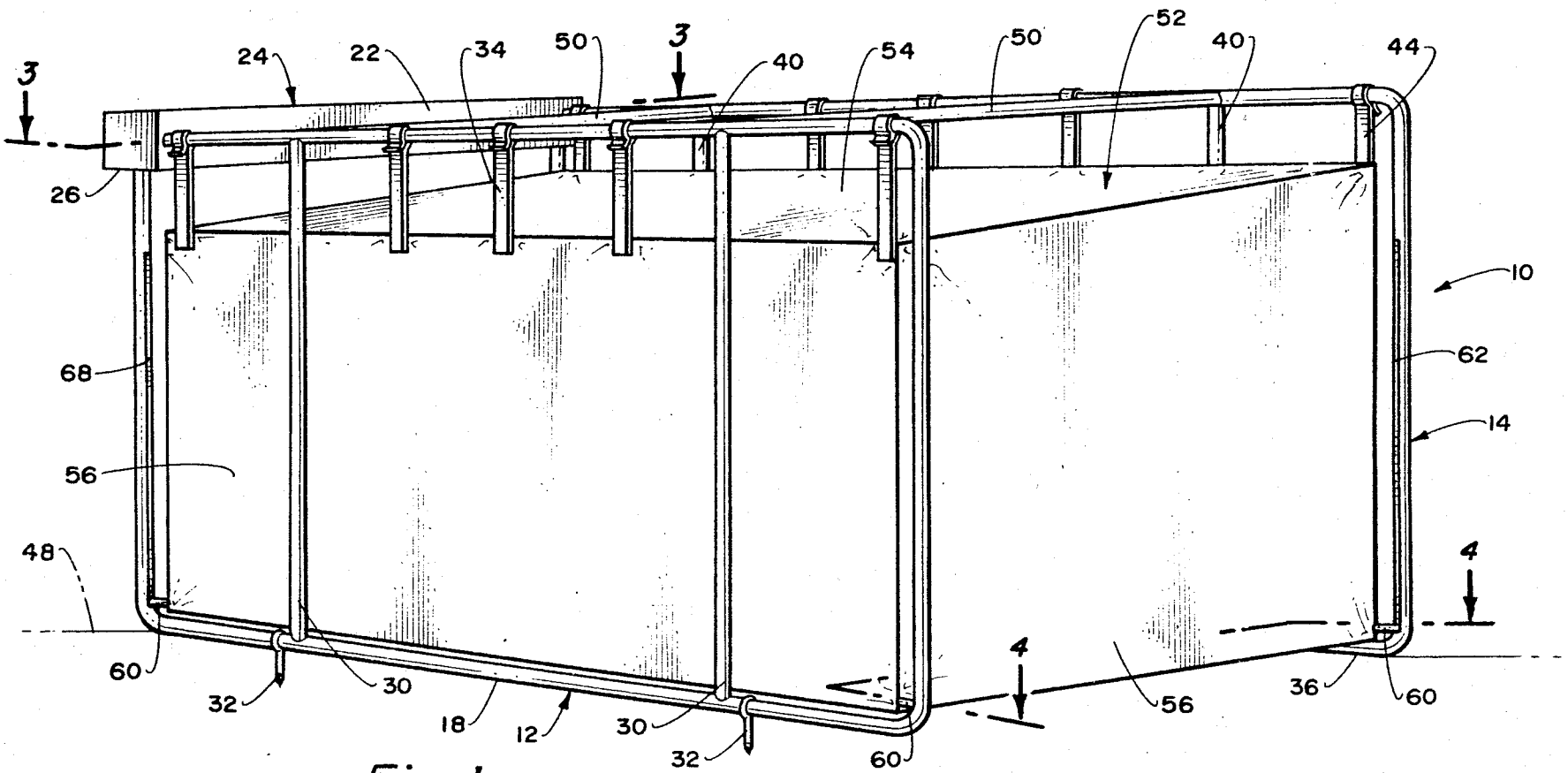
FIG. 1 is an isometric view of the movable enclosure of the present invention, showing the movable enclosure in the closed position.

Extending from the top section 54 are a plurality of side panels 56. These side panels 56 are actually four in number and are all connected together, so when the side panels 56 are in their extended position, shown in FIG. 1, the panels 56 as well as the top section 54 function to enclose the storage compartment and thereby protect the automobile 16 from the elements. It is to be noted that the inside surface of the cover 52 does not contact any portion of the automobile 16.

The open edge of the cover 52 has attached thereto a rigid rod 58. At each of the four corners of the cover 52 there is connected to the rod 58 an arm 60. It is to be understood that there will be four in number of the arms 60. One arm 60 is conducted through a slot 62 formed within the outermost vertical section of the tube 36. In a similar manner, another arm 60 connects with a slot 64 also formed within the outermost vertical section of the tube 18. Still further, an arm 60 connects with the slot 66 formed in the innermost vertical section of the tube 36. And still further, an arm 60 connects with a slot 68 formed with the innermost vertical section of the tube 18.

Located within the continuous internal chamber 20 and extending extirely therethrough is a cable 70. This cable 70 is conducted around a pulley 72 to an attaching plate 74. From the attaching plate 74, there is another section of the cable 70 that extends therefrom and is conducted around a pulley 76 and into the continuous internal chamber 38 of the tube 36. After the cable 70 is conducted entirely through the internal chamber 38 it re-enters the internal cavity 28 of the housing 24 through the bottom panel 26. The cable 70 is then conducted over pulley 78 to a second pulley 80 from where it enters the continuous internal chamber 20.

Also located within the internal chamber 20 is a second cable 82. This second cable 82 connects with a pulley 84 and then is fixedly secured to an attaching plate 86. From the attaching plate 86, the cable 82 is conducted around a pulley 88 and then also into the continuous internal chamber 38. This cable 82 is then conducted back into the interior cavity 28 about pulley 78 and then about pulley 80 and back into the continuous internal chamber 20. It is to be noted that the cables 70 and 82 are side-by-side within the continuous internal chambers 20 and 38.

Figure 3:
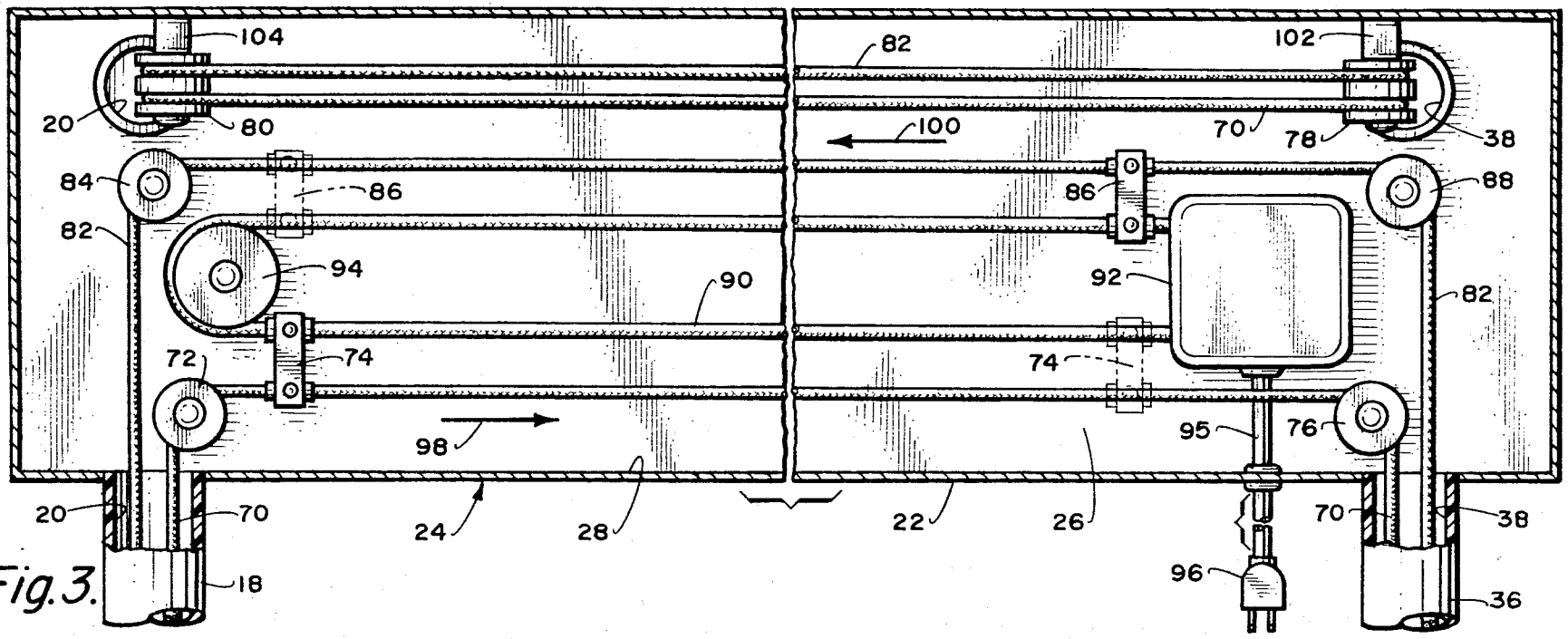
FIG. 3 is a cross-sectional view through the motor housing incorporated within the enclosure of the present invention taken along line 3—3 of FIG. 1.
Figure 4:
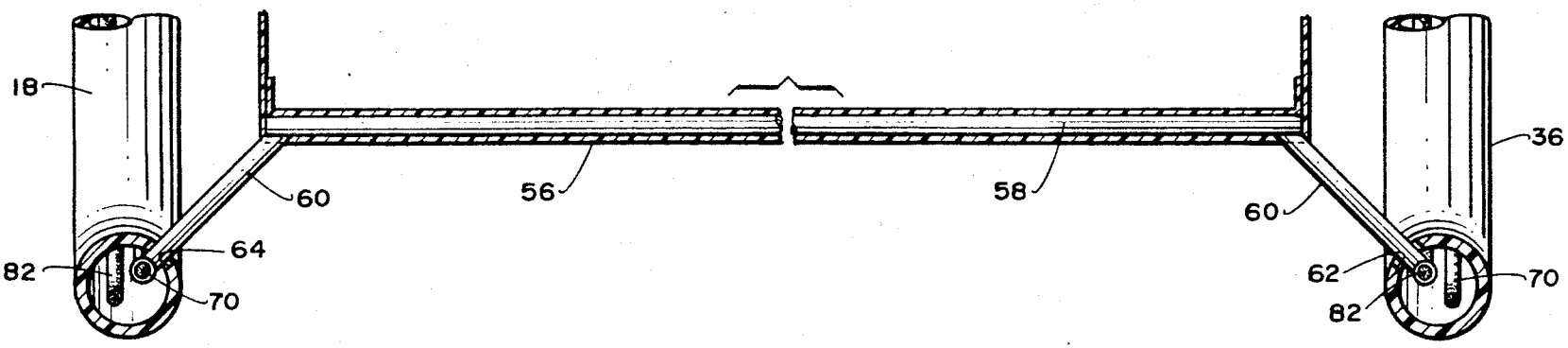
FIG. 4 is a cross-sectional view through a portion of the frame of the enclosure of the present invention taken along line 4—4 of FIG. 1.

The arm 60 which connects with slot 64 is fixedly secured to cable 70. With the arm 60 in the position shown in FIG. 1 of the drawings, the attaching plate 74 is in the position shown in FIG. 3 of the drawings. Also the arm 60 (not shown) which connects with the slot 66 is fixedly secured to the cable 70. The arm 60 which connects with the slot 62 is fixedly secured to the cable 82 as is also arm 60 which connects with the slot 68.

The attaching plate 74 is fixedly mounted onto an operating cable 90. This operating cable 90 is basically U-shaped in configuration and extends from a motor housing 92 about an idler pulley 94. This operating cable 90 can either take the form of a cable, a chain, or a V-belt. Within the motor housing 92 is to be located a conventional motor (not shown) which in turn is electrically driven through the electrical conductor 95 and plug 96 which extends exteriorly of the housing 24.

The motor 92 as well as the belt 90 and pulley 94 are part of what is termed a conventional "garage door opener". Normally, the operation of the motor 92 will be by means of a transmitter (not shown) which emits a soundwave at a pre-established frequency which will activate the motor within the motor housing 92. The motor 92 will be a reversible type motor and when activated from the position shown in FIG. 3, will cause the attaching plate 86 to move from the shown solid line position to its dotted line position shown directly adjacent the pulley 94. In a similar manner, the attaching plate 74 will move from its solid line position to its dotted line position shown directly adjacent the motor housing 92. Once the attaching plates 86 and 74 reach their dotted line position, the motor within the motor housing 92 will automatically stop. Reactivation of the motor will cause the attaching plates to move back to their solid line position.

To move the attaching plate 74 from the solid line position to its dotted line position, the cable 70 moves in the direction of arrow 98. When cable 98 moves in this direction, the two arms 60 that connect with the cable 70 are moved from the position shown in FIG. 1 to the position shown in FIG. 2 locating the arms 60 directly adjacent the top cover 54. At the same time, the cable 82 is moved in the direction of arrow 100 which causes the arms 60 to which it is connected to similarly move directly adjacent the top cover 54. As a result, side panels 56 of the cover 52, as such are shown in FIG. 2, are "bunched" against top cover 54 to permit the automobile 16 to be readily moved into and out of the storage compartment.

It is to be noted that the pulley 78 is rotatably mounted on a bracket 102. This bracket 102 is fixedly mounted onto the wall of interior cavity 28. Similarly, the pulley 80 is rotatably mounted on attaching bracket 104 which is also fixedly mounted onto the wall of cavity 28. It is to be understood that similar brackets will be utilized to mount the pulleys 72, 76, 84, 88 and 94.

It is to be understood that, if desired, the motor within the motor housing 92 could be operated by other than by a transmitter type device. For example, a simple key switch arrangement could be utilized.

It is further to be understood that if the movable enclosure 10 of this invention was to be utilized within a colder environment, there may be incorporated an insulative material in conjunction with the cover 52. Possibly there may be included within the top panel 54 an electrical coil arrangement in order to melt any accumulated snow on the top panel 54 as well as keeping the enclosed environment of the cover 52 at a warmer temperature in order to facilitate the starting of the automobile 16.

What is claimed is:

1. A movable storage enclosure for a vehicle or the like comprising:

a frame assembly composed of a pair of side frame sections, said side frame sections located in juxtaposition forming a storage compartment therebetween, each said side frame section having a peripheral edge member, each said peripheral edge member being hollow forming a continuous internal chamber within its respective said frame section;

a housing connected to each said side frame section and extending across said storage compartment, said housing having an interior cavity, said continuous internal chamber of each said side frame section connecting with said interior cavity;

motor means mounted within said interior cavity, a cable assembly connected to said motor means, said cable assembly being movable by activation by said motor means, said cable assembly extending within both said continuous internal chambers; and a thin, sheet material, flexible cover located within storage compartment, said cover having a plurality of corners, each said corner being connected to said cable assembly, activation of said motor assembly causes said corners to move between an upper position and a lower position, whereby when said corners are moved to said lower position said storage compartment is substantially enclosed and when said corners are moved to said upper position free access is permitted into and out of said storage compartment.

2. The movable storage enclosure as defined in claim 1 wherein:

said cable assembly comprising two in number of separate cables, during movement of said cover between said upper position and said lower position said separate cables are each moving in relative opposing directions.

3. The movable storage enclosure as defined in claim 2 wherein:

said corners are four in number, two of said corners being connected to one of said cables with the other two of said corners being connected to the other of said cables.

4. The movable storage enclosure as defined in claim 3 wherein:

said motor means include an operating cable said separate cables of said cable assembly being connected to said operating cable.

5. The movable storage enclosure as defined in claim 4 wherein:

said cover having a top, said top remaining stationary during movement of said corners, with said corners in said upper position said corners being located directly adjacent said top.

6. The movable storage enclosure as defined in claim 5 wherein:

said cover defining a peripheral open edge, said corners being located among said peripheral open edge, a rigid rod being connected to said cover at said peripheral open edge.

* * * * *